United States Patent [19]

Watanabe et al.

[11] Patent Number: 4,461,588

[45] Date of Patent: Jul. 24, 1984

[54] SERIAL PRINTING MECHANISM

[75] Inventors: Shuichi Watanabe, Neyagawa; Noboru Katakabe, Uji; Toshiharu Sasaki, Kawanishi, all of Japan

[73] Assignee: Matsushita Electric Industrial Co., Ltd., Kadoma, Japan

[21] Appl. No.: 389,151

[22] Filed: Jun. 16, 1982

[30] Foreign Application Priority Data

Jun. 19, 1981 [JP] Japan ..... 56-95843
Nov. 19, 1981 [JP] Japan ..... 56-186265

[51] Int. Cl.[3] ..... B41J 1/30; B41J 25/30
[52] U.S. Cl. ..... 400/144.2; 400/185; 400/320; 400/328
[58] Field of Search ..... 400/185, 144.2, 144.3, 400/320, 322, 323, 328

[56] References Cited

U.S. PATENT DOCUMENTS 4,178,107 12/1979 Guerrini et al. ..... 400/144.2
4,239,400 12/1980 Giolitti ..... 400/144.2
4,379,646 4/1983 Maeda ..... 400/185 X
4,386,863 6/1983 Rooney ..... 400/185

*Primary Examiner*—Paul T. Sewell
*Attorney, Agent, or Firm*—Wenderoth, Lind & Ponack

[57] ABSTRACT

A serial printing mechanism which employs a type wheel having a plurality of type characters has a single motor mounted on a carriage employed to accomplish plural functions. The single motor selectively rotates the type wheel to locate the predetermined type character in front of the typing position, and shifts the carriage. The carriage drive which shifts the carriage along a platen is powered by the single motor through a clutch which selectively engages the motor with the carriage drive.

8 Claims, 11 Drawing Figures

SERIAL PRINTING MECHANISM

BACKGROUND OF THE INVENTION

This invention relates to a serial printing mechanism for typewriters, printers and the like, and more specifically to a electromechanical serial printing mechanism with a rotary type wheel.

Printing apparatus which employs a type wheel having type characters on its periphery is put to practical use in typewriters, output devices of computers and the like. Such printing apparatus needs individual expensive motors and controllers for each function such as revolution of the type wheel, shifting of the carriage and paper feed. Therefore it is difficult to produce at a low cost.

SUMMARY OF THE INVENTION

It is an object of the invention to privide a low cost serial printing mechanism in which one motor carries out plural functions.

It is another object of the invention to provide a serial printing mechanism which does not need wires or belts for shifting the carriage so that its performance does not deteriorate due to a change in the tension of the wire or belt drive.

It is still another object of the invention to provide a serial printing mechanism which is easy to handle, to assemble and to maintain, because the drive mechanisms are concentrated on the carriage.

These and other objects, features and advantages will appear more fully hereinafter from a consideration of the following description taken in connection with the accompanying drawings in which:

DETAILED DESCRIPTION OF THE INVENTION

Figure 1:
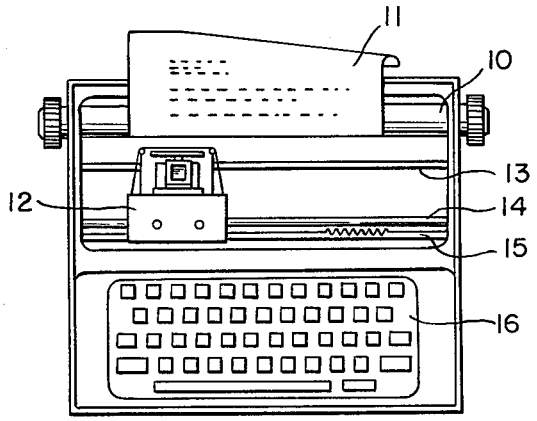
FIG. 1 is a schematic illustrations of a typewriter embodying the present invention.

As shown in FIG. 1, a sheet of paper 11 is set on a platen 10, and advanced by revolution of the platen 10. A carriage 12 provided with typing mechanism including a type wheel and an ink ribbon is slidably supported by guide rods 13 and 14, which are fixed parallel with the platen 10. The carriage 12 is shifted along the platen 10 by the rotation of a gear (to be described later) which is mounted on the carriage 12 and engaged with a rack 15 fixed parallel with the guide rods 13, 14.

In this embodiment according to the present invention, the typing mechanism including the carriage is electrically connected with an input unit such as a keyboard 16 through a control circuit (not shown). Therefore, the typing mechanism is operable in response to external signals received by the control circuit, and available for use as an output device of computers and the like.

Figure 3:
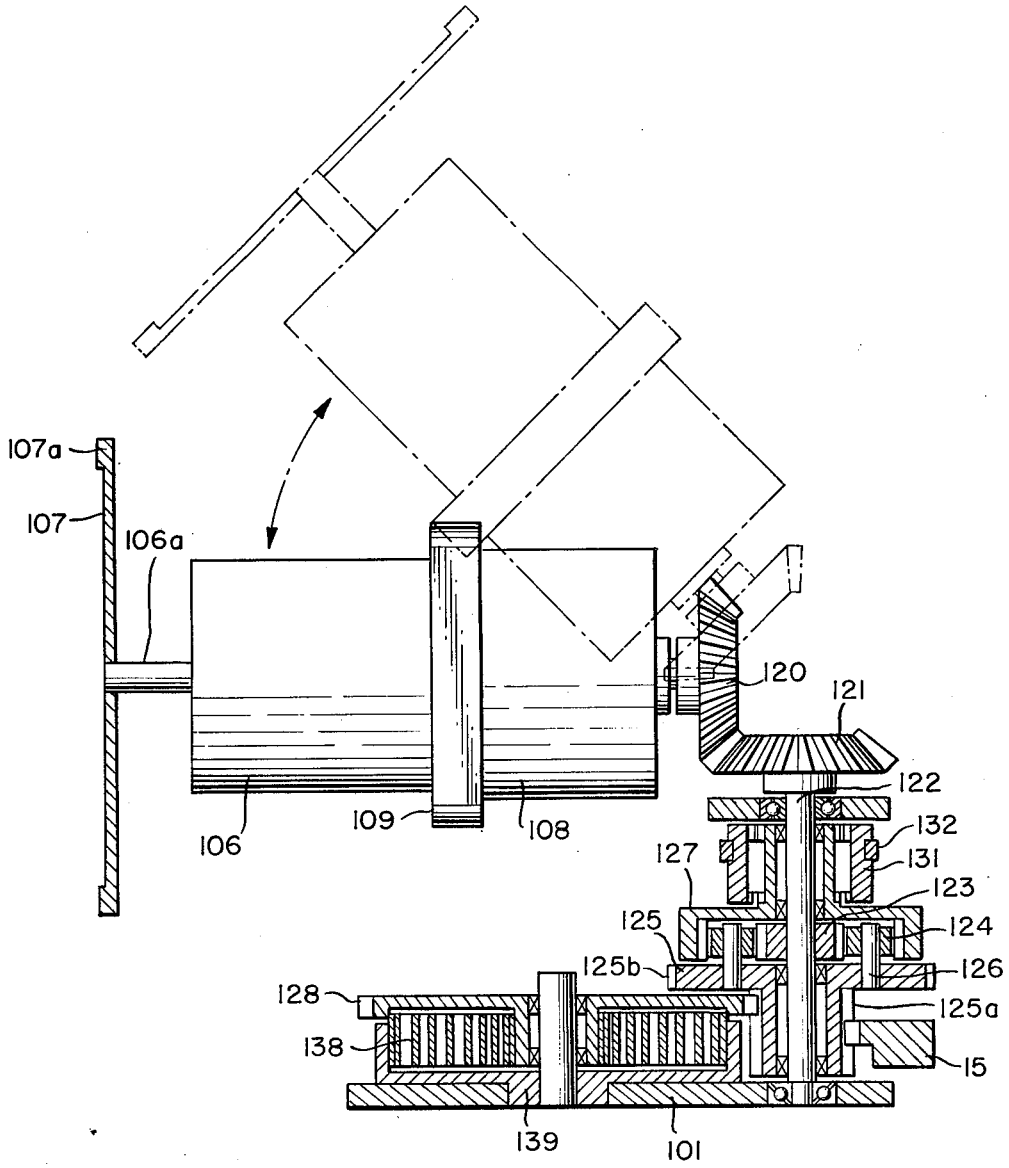
FIG. 3. is a sectional view of the carriage in FIG. 2.
Figure 2:
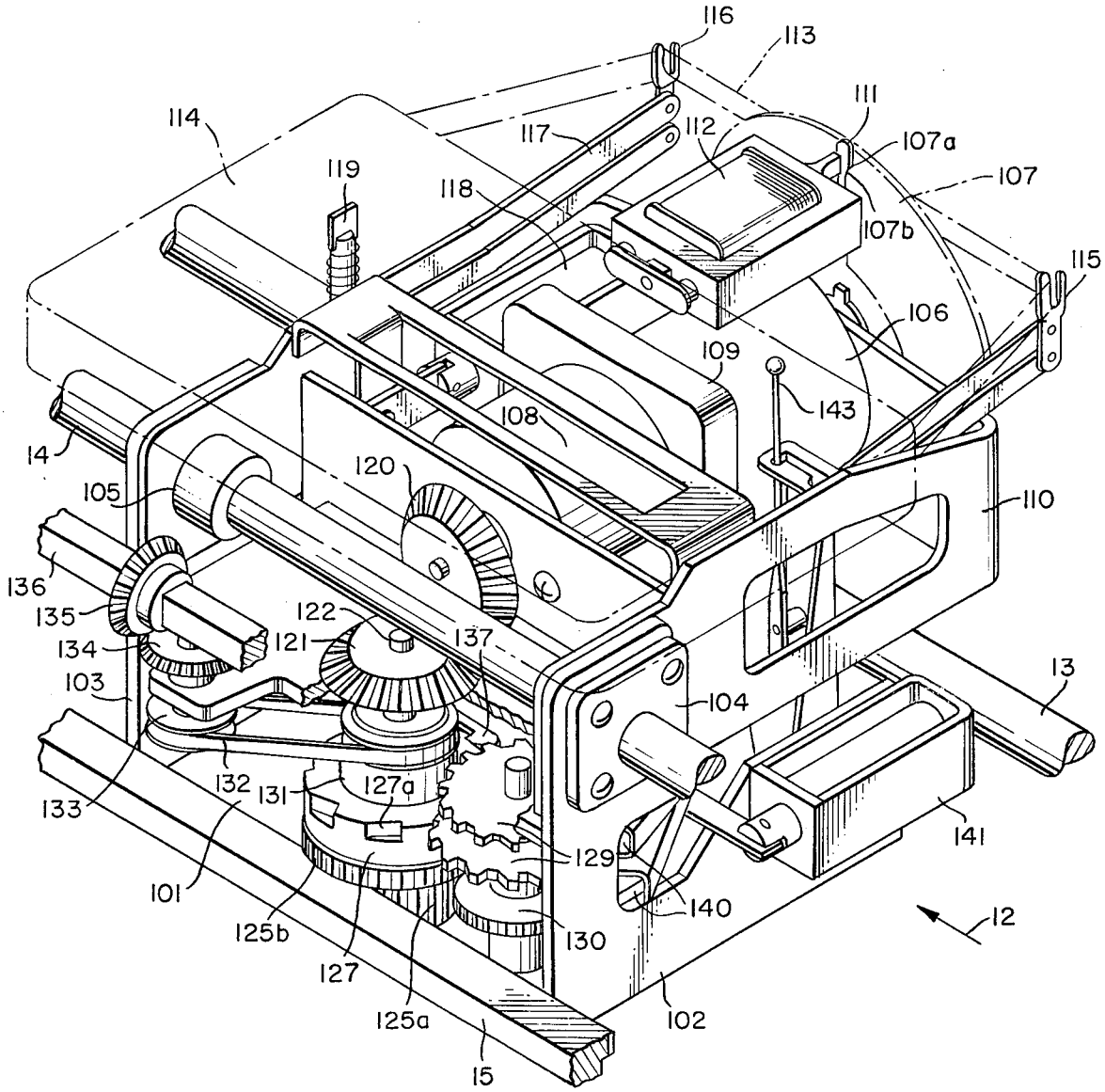
FIG. 2 is a perspective view of a carriage according to the present invention.

As shown in FIG. 2 and FIG. 3, the main frame of the carriage 12 consists of a base plate 101 and side plates 102 and 103, and is slidably supported on the guide rods 13 and 14 by a guide (not shown) mounted on the base plate 101 and bearing bushings 104 and 105 severally mounted on the side plates 102 and 103. A type wheel 107 is provided on one end of a shaft 106*a* of a servo motor 106, and the other end of the shaft 106*a* is coupled with a clutch 108. The servo motor 106 operably drives the type wheel 107, the carriage 12 and paper feed mechanisms (not shown). A detector 109 for detecting the angular position of the shaft 106*a* of the servo motor 106 is mounted on the servo motor 106. The control circuit (not shown) operably drives the servo motor 106 according to the signal from the detector 109 and the keyboard 16. The servo motor 106 and the clutch 108 are mounted on a sub-frame 110 which is rotatable around the bearing bushings 104 and 105. At the position of the sub-frame 110 as shown in double dotted lines in FIG. 3, it is easy to exchange the type wheel 107.

The type wheel 107 had radially extending arms with a type character 107*a* carried on the end of each arm 107*b*. As the arm 107*b* is resilient, a print hammer 111 impresses the type character 107*a* against the paper 11 on the platen 10. The print hammer 111 is operably actuated by a hammer solenoid 112.

An ink ribbon 113 shown in double doted lines in FIG. 2 is stored in a ribbon cartridge 114, and fed from the right end of the cartridge 114, and passes through a ribbon guide 115, between the type wheel 107 and the paper 11 on the platen 10, and through a ribbon guide 116, and collected into the left end of the cartridge 114. The ribbon guides 115 and 116 are pivotally mounted on the ends of a ribbon arm 117, and actuated vertically by a ribbon drive solenoid 118. In order to permit the operator to see the printed text, the ink ribbon 113 is normally in a rest position under the printing line. The operation of the ribbon drive solenoid 118 lifts up the ink ribbon 113 to the level of the printing line, simultaneously rotates a tape engagement prong 119 coupled with a take-up roller (not shown) which collects the ink ribbon 113 and is mounted on the ribbon cartridge 114. In each typing operation, fresh ink ribbon 113 is fed from the right end of the cartridge 114, and the used ink ribbon 113 is returned into the left end of the cartridge 114.

The clutch 108 operably transmits torque from an input axle to an output axle in response to the electric signal from the control circuit. The input axle of the clutch 108 is coupled with the shaft 106*a* of the servo motor 106, and the output axle is equipped with a bevel gear 120. A bevel gear 121 engaged with the bevel gear 120 is mounted on a main shaft 122 which is rotatably supported vertically. Therefore the rotation of the output axle of the clutch 108 is transmitted to the main shaft 122 through the pair of bevel gears 120 and 121.

A sun gear 123 is fixed on the main shaft 122. Planet gears 124 severally engaged with the sun gear 123 are rotatably supported by shafts 126 provided on a carrier 125. An internal gear 127 engages with the planet gears 124. The sun gear 123, the planet gears 124 and the internal gear 127 compose the planetary gear.

The carrier 125 is rotatably supported on the main shaft 122, and is constituted by two gears 125*a* and 125*b* having gear teeth around the outer side. One gear 125*a* is engaged with the rack 15 and a spring gear 128, and the other gear 125*b* is engaged with a gear 130 coaxially fixed on a ratchet wheel 129.

A one-way clutch 131 attached to the internal gear 127 transmits only counter clockwise motion of the internal gear 127 to a pulley 133 through a belt 132. The counterclockwise motion of the internal gear 127 is further transmitted to a square shaft 136 through a pair of bevel gears 134, 135. The bevel gear 135 is slidably mounted on the square shaft 136, and shifts along with the carriage 12. The internal gear 127 has notches 127*a* around the outer side, which operably engage a pawl 137 for stopping clockwise motion of the internal gear 127.

The outer end of a spring 138 is fixed to a spring case 139 mounted on the base plate 101, and the inner end of the spring 138 is fixed to the spring gear 128. A ratchet 140 is engaged with the ratchet wheel 129, whereby the shifting of the carriage 12 by the stored energy in the spring 138 is prevented. When the ratchet 140 is disengaged from the ratchet wheel 129 by means of the operation of a spacing solenoid 141, the stored energy in the spring 138 rotates the carrier 125 clockwise, and shifts the carriage 12 to the right. The spring 138 is wound up during the shifting of the carriage 12 left.

Figure 4A:
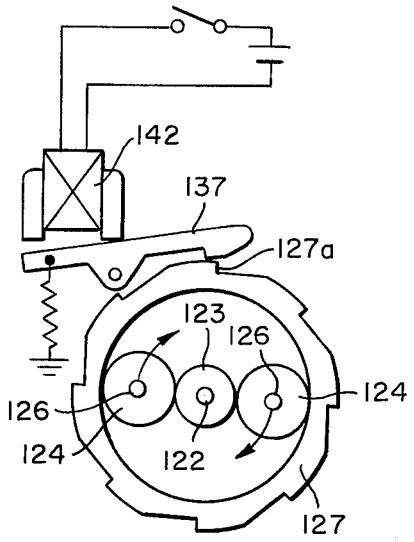
FIGS. 4 (*a*)–(*c*) are fragmentary plan views showing the operation of a planetary gear.
Figure 4B:
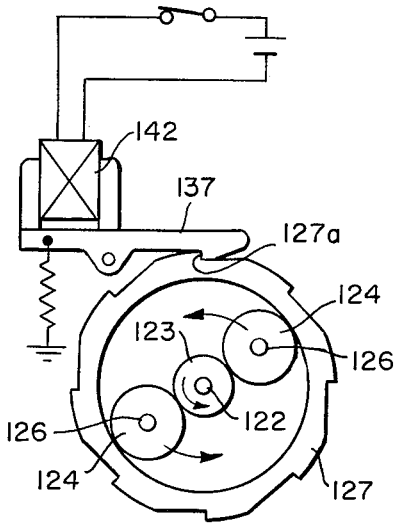
Figure 4C:
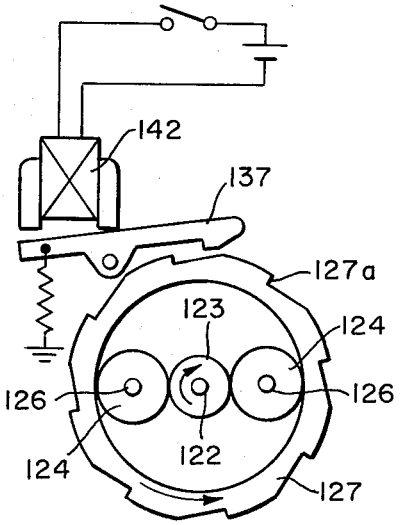

The operation of the planetary gear will be described with reference to FIG. 4. The pawl 137 is normally disengaged from the notch 127*a*. When carriage 12 is to be shifted right, the carrier 125 is rotated clockwise by the spring 138, and the internal gear 127 and the sun gear 123 are rotated clockwise freely. (FIG. 4(*a*))

When the carriage 12 is to be shifted left, the pawl 137 is engaged with the notch 127*a* by the operation of the solenoid 142, and the servo motor 106 drives the sun gear 123 counterclockwise through the engaged clutch 108. As the clockwise motion of the internal gear 127 is prevented by the pawl 137, the carrier 125 is driven counterclockwise, whereby the spring 138 is wound up. (FIG. 4(*b*))

When the servo motor 106 drives the sun gear 123 clockwise after disengaging the pawl 137 from the notch 127*a*, the internal gear 127 is driven counterclockwise because the engagement of the ratchet 140 and the rachet wheel 129 prevents the clockwise motion of the carrier 125. The counterclockwise motion of the internal gear 127 is transmitted to the square shaft 136 through the one-way clutch 131, the belt 132, the pulley 133 and the bevel gears 134 and 135. (FIG. 4(*c*))

Figure 5A:
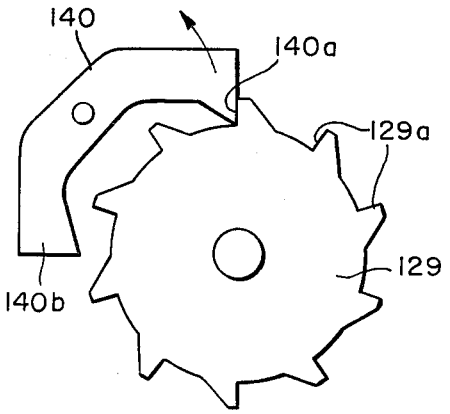
FIGS. 5 (*a*) and (*b*) are fragmentary plan views showing the operation of a ratchet and a ratchet wheel.
Figure 5B:
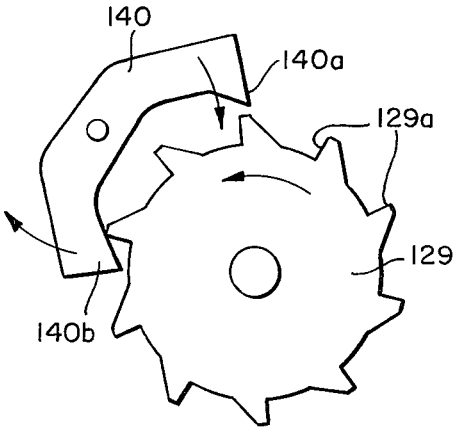

Referring to FIG. 5, a tooth 129*a* of the ratchet wheel 129 is engaged by the end 140*a* of the rachet 140, therefore the rachet wheel 129 is blocked from rotating due to the stored energy in the spring 138. (FIG. 5(*a*))

The operation of the spacing solenoid 141 gives a counterclockwise motion to the ratchet 140, and releases the engagement, the ratchet wheel 129 starts to rotate counterclockwise due to the stored energy in the spring 138. As shown in FIG. 5(*b*), as the ratchet wheel 129 rotates, the tooth 129*a* pushes away the other end 140*b* of the ratchet 140. The ratchet 140 is given a clockwise motion. After the ratchet wheel 129 rotates one pitch, the end 140*a* of the ratchet 140 engages with the tooth 129*a* of the rachet wheel 129, and the ratchet wheel 129 is again arrested.

Each rotation of one pitch of the ratchet wheel 129 provides carriage shifting of one pitch. In this embodiment of the present invention, two ratchet wheels which are different in pitch, are arranged coaxially, and two ratchets which severally combine with the ratchet wheels, are provided. The operation of a pitch change lever 143 (in FIG. 2) moves two ratchets 140 alternately between an operational position and a non-operational position. Therefore when one ratchet is in operation, the other ratchet is out of operation. The operator can change the typing pitch by the operation of the pitch change lever 143.

Each operation in several modes of the embodiment of the present invention will be described.

1. PRINTING

When the operator operates the keyboard 16, the control circuit (not shown) receives the signal from the keyboard 16, and generates a control signal which drives the servo motor 106. The servo motor 106 rotates the type wheel 107 corresponding to the control signal, and locates the predetermined type character 107*a* in front of the printing position. Simultaneously, the ribbon drive solenoid 118 lifts up the ink ribbon 113 to the level of the printing line and feeds it. Afterwards the print hammer 111 driven by the energized hammer solenoid 112 strikes the located type character 107*a* against the paper 11. The letter is printed as the ink ribbon 113 is between the paper 11 and the located type character 107*a*.

After printing, the hammer solenoid 112 is turned off, and the print hammer 111 is returned to the initial position by a return spring (not shown). The ribbon drive solenoid 118 is also turned off, and therefore the ink ribbon 113 returns to under the printing line.

Thereafter, as the energized spacing solenoid 141 releases the engagement of the ratchet 140 and the ratchet wheel 129, the ratchet wheel 129 is rotated one pitch by the spring 138, and the carriage 12 shifts one pitch to the right.

2. SPACING

The spacing solenoid 141 operates, and the carriage 12 shifts one pitch to the right in the same manner as in printing.

3. CARRIAGE RETURN

The clutch 108 is energized, and the pawl 137 is engaged with the notch 127*a* of the internal gear 127 by the energized solenoid 142. Thereafter the servo motor 106 drives the carrier 125 counterclockwise, and therefore the carriage 12 shifts left and the spring 138 is wound up.

After carriage shifting, the paper 11 is fed by well known paper feed mechanisms (not shown) as described later.

4. PAPER FEED

The servo motor 106 drives the sun gear 123 clockwise through the engaged clutch 108. As the carrier 125 is arrested by the ratchet wheel 129 which is engaged by the ratchet 140, the internal gear 127 is driven counterclockwise. The rotation of the internal gear 127 is transmitted to the square shaft 136, and further to the well known paper feed mechanisms (not shown). The paper feed mechanisms rotate the platen 10 a certain angle using the power of the servo motor 106, and the paper 11 is fed.

Figure 6:
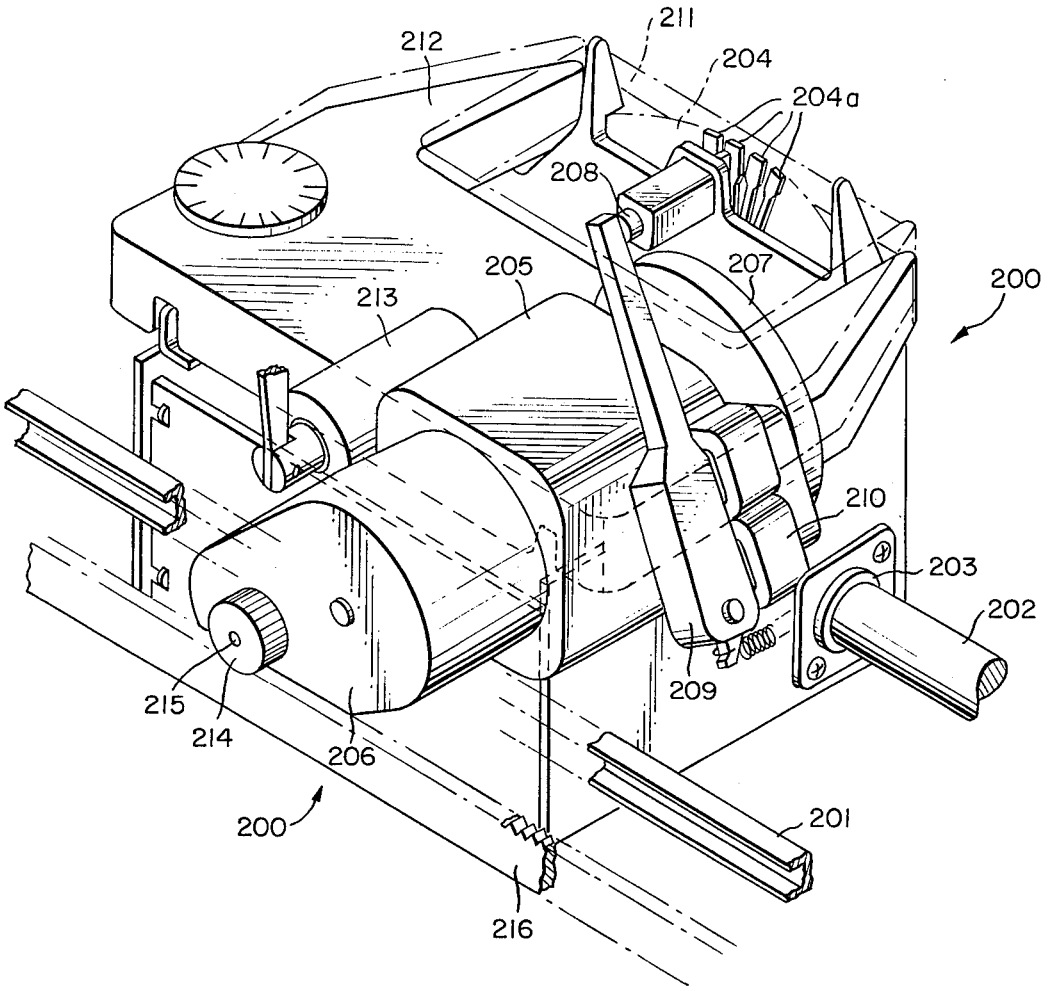
FIG. 6 is a perspective view of another embodiment of the carriage of the present invention.
Figure 7A:
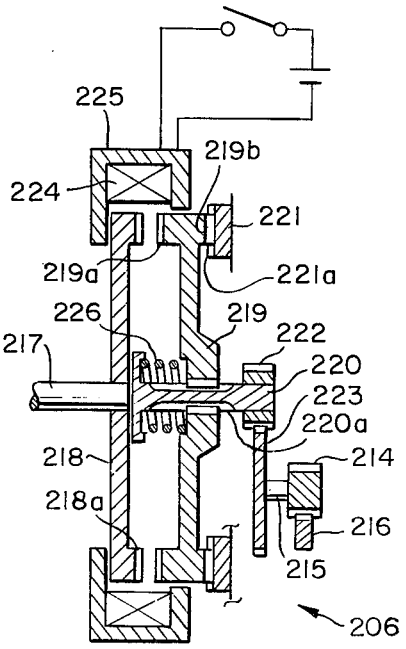
FIGS. 7 (*a*) and 7 (*b*) are sectional views showing the operational position of the clutch in FIG. 6.
Figure 7B:
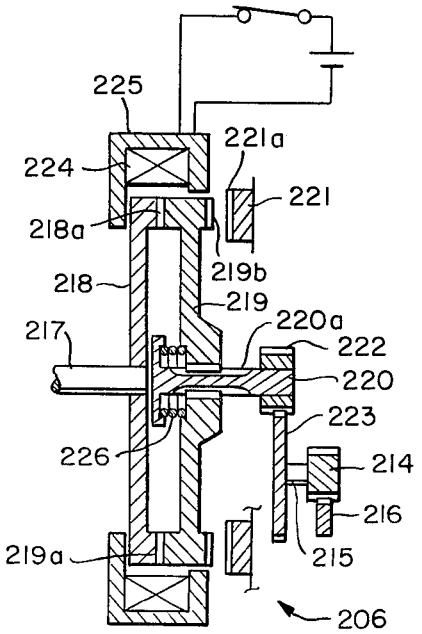

Another embodiment of the invention is illustrated in FIGS. 6 and 7.

As shown in FIG. 6, a carriage 200 is slidably supported on the guide rods 201 and 202 with a guide (not shown) and bearing bushings 203. A type wheel 204 is provided on one end of the shaft of a stepping motor 205. The other end of the shaft of the stepping motor 205 is coupled with a clutch 206. The stepping motor 205 operably drives the type wheel 204 and the carriage 200. A detector 207 is arranged for detecting the angular position of the stepping motor 205. Based on the signal from the detector 207, a control circuit (not shown) initializes the angular position of the type wheel 204 and the control circuit itself is switched on, and checks the angular position of the type wheel 204 in the operation. A print hammer 208 which strikes the type character 204*a* is driven by a hammer lever 209 which is operably driven by a hammer solenoid 210. An ink ribbon 211 is stored in a ribbon cartridge 212, and actuated vertically and fed transversely by the operation of a ribbon drive solenoid 213. A gear 214 is fixed on an output shaft 215 of the clutch 206, and engaged with the rack 216. The carriage 200 is shifted by the revolution of the gear 214.

As shown in FIG. 7, a rotor 218 is fixed on the end of an input shaft 217 coupled with the shaft of the stepping motor 205. The rotor 218 is has a row of teeth 218*a* annularly arranged around the peripheral edge of one face thereof. An armature 219 in the form of a disc is axially slidable on a splined part 220*a* of an interim shaft 220. Two rows of teeth 219*a* and 219*b* are formed, one on each face. The teeth 219*a* are operably engageable with the teeth 218*a* on the rotor 218. The other teeth 219*b* are operably engageable with the teeth 221*a* on a lock plate 221 fixed on the clutch case. A first interim gear 222 fixed on the end of the interim shaft 220 is engaged with a second interim gear 223 fixed on the output shaft 215. The rotation of the rotor 218 is transmitted to the output shaft 215 through armature 219 the interim shaft 220, and the first and second interim gears 222 and 223. The rotor 218 and the armature 219 are made of magnetic material and are encircled by a coil 224 and a core 225. A release spring 226 biases the armature 219 axially toward engagement with the lock plate 221. Therefore the output shaft 215 is arrested and the carriage 200 is at a halt. (FIG. 7(*a*))

When the coil 224 is energized, the armature 219 is attracted against the force of the release spring 226, and engaged with the rotor 218. Then the carriage 200 is shifted by the stepping motor 205. (FIG. 7(*b*)

The gear ratio between the first and second interim gears 222 and 223, and the pitch and number of the teeth of the gear 214 are chosen so that the carriage 200 shifts one pitch of spacing for each turn of the shaft of the stepping motor 205.

Operation in the printing mode is as follows. The stepping motor 205 drives the type wheel 204 according to the control signal from the control circuit (not shown), and locates the predetermined type character 204*a* in front of the printing position. Simultaneously, the energized ribbon drive solenoid 213 lifts the ink ribbon 211 to the printing line and feeds it. And the hammer solenoid 210 is energized and the hammer 208 strikes the type character 204*a* against the paper (not shown).

Thereafter, the hammer solenoid 210 and the ribbon drive solenoid 213 are deenergized and the ink ribbon 211 and the hammer 208 return to the waiting position.

After printing, the clutch 206 is energized, then the stepping motor 205 makes a revolution and the carriage 200 shifts one pitch of spacing. Subsequently, the clutch 206 is deenergized and the carriage 200 is halted.

After carriage 200 shifts, the type wheel 204 returns where it was before the shifting. The characters of the type wheel 204 are arranged by frequency of use. Therefore character locating time is reduced. In the carriage shifting mode such as spacing and carriage return, as aforementioned, the stepping motor 205 shifts the carriage 200 right or left through the engaged clutch 206.

Although two embodiments have been shown and described, obviously many modifications and variations are possible in the illustrated mechanisms described above. For example, the type wheel may be replaced by a type belt composed of a flexible band loop provided with a plurality of type characters.

What is claimed is:

1. A serial printing mechanism for typewriters or printers, comprising:
   - a platen for holding a paper;
   - a carriage reciprocally movable along a predetermined printing line on said platen;
   - carriage drive means connected to said carriage for reciprocally shifting said carriage along said predetermined printing line;
   - a type wheel rotatably mounted on said carriage and having a plurality of type characters;
   - a motor mounted on said carriage and having an output shaft connected to said type wheel for selectively rotating said type wheel to locate a predetermined type character in front of a printing position;
   - a print hammer means mounted on said carriage for pressing the type character located in front of the printing position against said platen;
   - a clutch means connected to said motor for selectively supplying power from said motor;
   - power output means for outputting power from said motor independently of said carriage drive means; and
   - distributing means connected between said clutch means and said carriage drive means and said power output means for taking out the power from said motor and selectively supplying it to said carriage drive means or said power output means;
   - said carriage drive means including means for blocking movement of said carriage drive means in one direction and holding said carriage against movement in the other direction when said clutch is disengaged.

2. A mechanism as claimed in claim 1 wherein said distributing means comprises a planetary gear means and a stop means selectively engaging said planetary gear means for causing said planetary gear means to selectively transmit the power of said motor to said carriage drive means or to said power output means.

3. A mechanism as claimed in claim 2 in which said planetary gear means has a sun gear coupled to said clutch means, and internal gear coupled to said power output means, and a carrier having at least one planetary gear thereon and coupled to said carriage drive means, said stop means being selectively engageable with said internal gear for blocking rotation of said internal gear.

4. A mechanism as claimed in claim 2 wherein said carriage drive means includes spring means for storing energy, means driven from said planetary gear means and connected to said carriage for shifting said carriage in said other direction and simultaneously supplying energy to said spring means when said clutch means connects said motor to said planetary gear means and for transmitting energy from said spring means to said carriage to shift said carriage in said one direction when said clutch means keeps said motor and said distributing means disengaged, said blocking means engaging said driven means for blocking movement of said driven means to drive said carriage in said one direction and means for selectively releasing said blocking means selectively releasing the stored energy in said spring means for shifting said carriage in said one direction.

5. A serial printing mechanism for typewriters or printers comprising:

a platen for holding a paper;

a carriage movable along a predetermined printing line on said platen;

a type wheel rotatably mounted on said carriage and having a plurality of type characters;

a motor mounted on said carriage and connected to said type wheel for selectively rotating said type wheel to locate a predetermined type character in front of a printing position;

print hammer means mounted on said carriage for pressing the type character located in front of the printing position against said platen;

carriage drive means connected to said carriage for reciprocally shifting said carriage along said predetermined line; and clutch means connected between said motor and said carriage drive means for selectively engaging said motor with said carriage drive means and including means for arresting said carriage drive means when said clutch means is disengaged and for releasing said carriage drive means for allowing said carriage drive means to be driven when said clutch means is engaged, whereby said carriage is interlocked with said motor for being shifted and is held against shifting when said clutch means is disengaged.

6. A mechanism as claimed in claim 5 wherein said carriage drive means comprises means for shifting said carriage one space when said motor makes an integral number of rotations.

7. A mechanism as claimed in claim 5 wherein said type wheel is directly mounted on the shaft of said motor.

8. A mechanism as claimed in claim 5 wherein said clutch means comprises a rotor connected to said motor and having a plurality of teeth on the peripheral edge of the surface thereof facing away from said motor, an armature rotatably mounted for rotation coaxial with said rotor and having a plurality of teeth on the peripheral edge of the surface facing said rotor and being axially movable for moving said teeth into and out of engagement with the teeth on said rotor, said carriage drive means being connected to said armature for being driven therefrom, and said arresting means comprising a further plurality of teeth on said armature facing away from said firstmentioned teeth thereon and coacting teeth fixedly mounted on said mechanism with which said further plurality of teeth are engaged when said armature is axially moved to disengage the teeth thereon from the teeth on said rotor, and said clutch means further comprises magnetic coil means for shifting said armature axially.

* * * * *